US005951069A

United States Patent [19]

Kobayashi et al.

[11] Patent Number: 5,951,069

[45] **Date of Patent: *Sep. 14, 1999**

[54] DOOR CLOSING APPARATUS

[75] Inventors: Norikazu Kobayashi, Chita; Hiroshi Ishihara, Kariya; Hiroyuki Mizushima, Aichi-ken; Ryujiro Akizuki, Toyota, all of Japan

[73] Assignee: Aisin Seiki Kabushiki Kaisha, Kariya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/842,355

[22] Filed: Apr. 24, 1997

[30] Foreign Application Priority Data

Apr. 26, 1996 [JP] Japan ..... 8-129247
Apr. 26, 1996 [JP] Japan ..... 8-129248

[51] Int. Cl.[6] ..... E05B 53/00

[52] U.S. Cl. ..... 292/201; 292/216

[58] Field of Search ..... 292/201, 216, 292/341.13, 341.16, DIG. 23, DIG. 43, DIG. 65

[56] References Cited

U.S. PATENT DOCUMENTS

| | | | |
|---|---|---|---|
| 4,986,579 | 1/1991 | Ishikawa | 292/201 |
| 5,180,198 | 1/1993 | Nakamura | 292/201 |
| 5,411,302 | 5/1995 | Shimada | 292/201 |
| 5,433,496 | 7/1995 | Zimmerman | 292/201 |
| 5,454,607 | 10/1995 | Ishihara et al. . | |
| 5,466,021 | 11/1995 | Ishihara et al. . | |
| 5,516,164 | 5/1996 | Kobayashi | 292/341.16 |
| 5,520,425 | 5/1996 | Dowling | 292/216 |
| 5,639,130 | 6/1997 | Rogers | 292/201 |

*Primary Examiner*—Suzanne Dino Barrett
*Assistant Examiner*—Gary Estremsky
*Attorney, Agent, or Firm*—Burns, Doane, Swecker & Mathis, LLP

[57] ABSTRACT

A door closer device includes an active lever which, when it is in an abnormal state-with respect to a latch lever, automatically returns a door to a normal state by means of a door closing operation. An active latch which is pivotably supported by an active lever is freely rotatable in one direction, but is rotation regulated by an arm of an active pawl, i.e. a cancel lever, in the other direction. This prevents the latch lever from jumping over the active latch and causing an abnormal state in which the active latch swings wide with respect to the latch lever.

4 Claims, 5 Drawing Sheets

DOOR CLOSING APPARATUS

BACKGROUND OF THE INVENTION

The present invention relates to an apparatus for closing a door of a vehicle, and more particularly to a door closing apparatus for bringing a door which is in a half-closed or latched condition automatically into a full-closed or latched condition.

Prior art attempts to produce a full-closed condition or a side door of a vehicle rely on the use of a structure which engages a striker which is a member of the body side of the vehicle with a latch comprising a part of a door lock apparatus provided on the side door. Referring to FIG. 6, there is shown a latch 1 which is universally pivotal around a pin 2 and which is forced to be in one direction at all times due to the urging force of a spring 3. The latch 1 includes an engaging groove 5 receiving a striker 4, a first projection 6 producing the full-closed condition of the door in a periphery thereof, and a second projection 7 making the half-closed condition of the door, to have a protrusion 9 of a pawl 8 universally engaged with both projections 6 and 7.

The pawl 8 is universally pivotal around a pin 9' and forced to stay in the direction of the latch 1 at all times by a spring 10. The pawl 8 is rotatable counterclockwise by the movement of a pin 11' of a lift lever 11 or the opening system of the door lock mechanism.

When the door is in the open condition, the engaging groove 5 lies in the right direction as viewed in FIG. 6, and the protrusion 9 of the pawl 8 comes in contact with an outer periphery 12 of the latch 1. Through the door closing operation, the striker 4 enters the engaging groove 5 and rotates the latch 1 forcibly counterclockwise, whereafter the protrusion 9 engages the second projection 7 to produce the half-closed condition of the door or the half-latch status, while a further door-closing operation permits the protrusion 9 to engage the projection 6, thus producing the full-closed condition of the door or the full-latch status (a condition shown in FIG. 6).

Note that 30 denotes a latch switch for detecting either one of door conditions of door open, door half-closed, or door full-closed conditions.

In the aforementioned operation of the conventional door closing apparatus, in the event of insufficient operating power or the like, the door closing operation may terminate while the door remains in the half-closed condition with the protrusion 9 of the pawl 8 still being engaged with the second projection 6. Consequently, a door closer mechanism is used to bring the door in the half-closed condition automatically into the full closed condition. Examples of this type of door closer are disclosed in Japanese Patent Laid-Open Publication Nos. 96079/1990 and 50045/1994.

It is known that the door closing mechanism employs a construction wherein a latch lever rotating the rotatable shaft of the latch is abutted on an active latch secured to an active lever which ascends and descends by the electric motor so that the latch lever is rotated according to the operation of the active latch. Upon detection of the half-closed condition of the door, the electric motor operates the active lever, such operation being transmitted via the active latch to the latch lever and automatically moving the latch from a position (half-latch status) corresponding to the half-closed condition of the door to a position (full-latch status) corresponding to the full-closed condition of the door according to the rotation of the latch lever.

However, the conventional door closing apparatus operate on a procedure, wherein the electric motor activates closing operation upon sensing that the latch switch is turned on or off, thereby creating a slight timing lag between the moment the latch switch is turned on or off and the moment the door reaches the half-closed condition, wherefore it cannot necessarily be maintained that the electric motor is operated for closing the door upon detecting the half-closed condition of the door. Further, there is another adverse factor, namely, a possibility that the closing operation is continued because of the lack of detection of the completely closed condition of the door.

However, sometimes the latch lever jumps over the active latch so that the movement of the active latch is not correctly transmitted to the latch lever and an abnormal state is created in which the active latch swings wide with respect to the latch lever. Consequently, the present invention has as its object to solve the above-described deficiencies of the prior art.

SUMMERY OF THE INVENTION

The present invention, in order to solve the above problems, provides a door closing apparatus comprising a latch which selectively takes a first position placing a door in an operable state or condition, a second position placing the door in a half-closed state or condition and a third position placing the door in a full-closed state or condition with respect to a member on an vehicle body, a pawl for maintaining any one of said positions of the latch, an electric motor which operates by detection of the half-closed state of the door, an active lever which moves along a constant straight line locus by means of the output of the electric motor, an active latch rotatably supported by the active lever, rotation of which in one direction is regulated and rotation of which is the other direction is allowed, and a latch lever fixed to the latch and having a free end facing the active latch, wherein, due to regulation of the rotation of the active lever in one direction, the active latch rotates the latch lever so that the latch takes the third position.

The present invention, for the purpose of the above-described cancel operation, further employs a technical means which, basically, interposes an active pawl, i.e. cancel lever, for regulating the movement of the active latch in one direction, between the active latch, which abuts with the latch lever, and the active lever, and allows the cancel lever to release regulation of the movement of the active latch in that one direction.

The present invention, specifically, provides a door closer device comprising a latch which selectively takes a first position placing a door in an operable state, a second position placing the door in a half-closed state and a third position placing the door in a fully-closed state with respect to a member on a vehicle body, a pawl for maintaining any one of said positions of the latch, an electric motor which operates by detection of the half-closed state of the door, an active lever which moves along a constant straight line locus by means of the output of the electric motor, an active latch rotatably supported by the active lever, a cancel lever capable of regulating rotation of the active latch in one direction and rotatably supported by the active lever, and a latch lever fixed to the latch and having a free end facing the active latch, wherein, due to regulation of the rotation of the active lever in one direction, the active latch rotates the latch lever so that the latch takes the third position, and rotation which results in the latch of the latch lever taking the third position is canceled by release of regulation of the rotation of the active lever in one direction by means of rotation of the cancel lever.

BRIEF DESCRIPTION OF THE DRAWINGS

These and other features, aspects and advantages of the present invention will become better understood with reference to the following description, appended claims and accompanying drawings, wherein:

DETAILED DESCRIPTION OF PREFERRED EMBODIMENT

Figure 1:
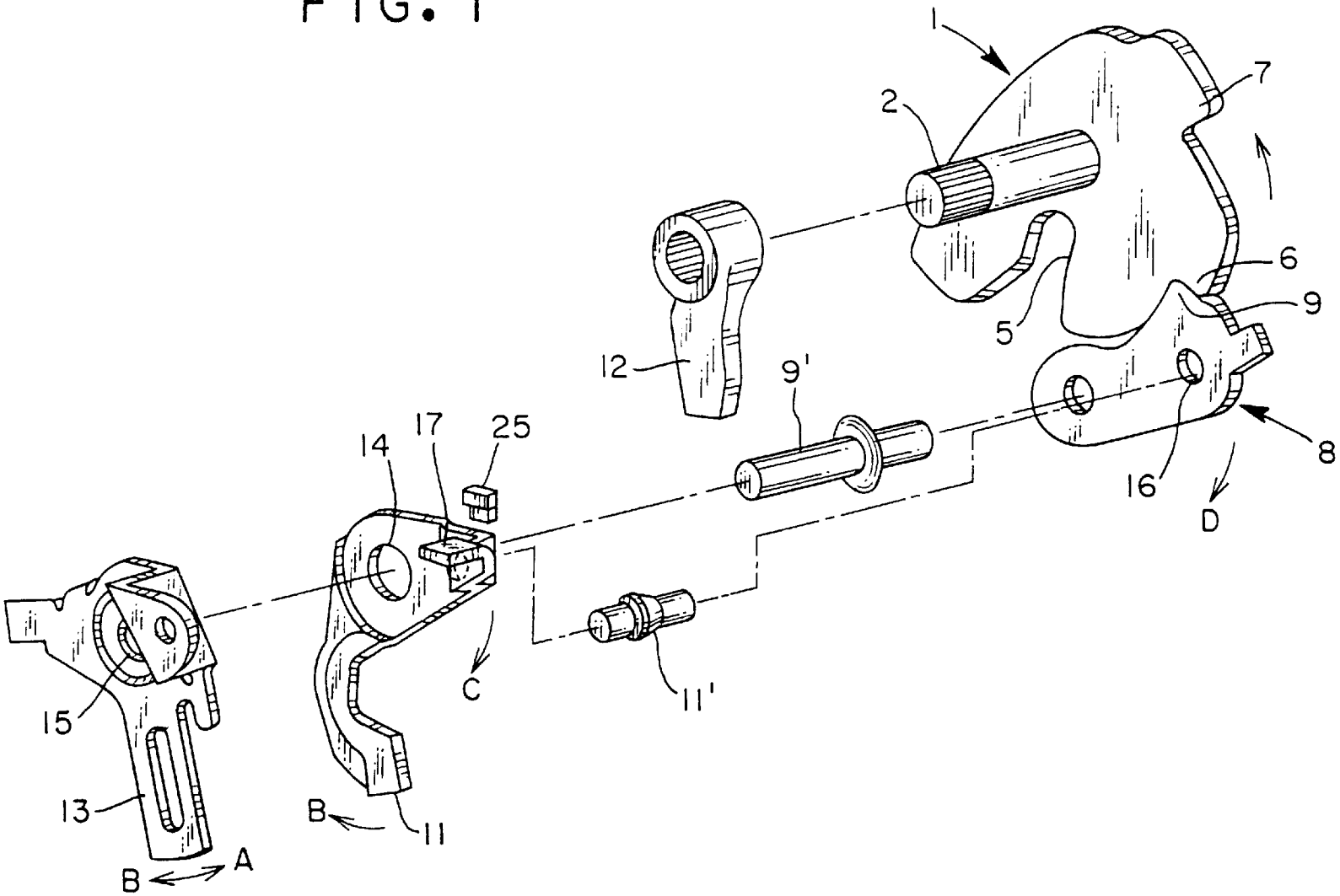
FIG. 1 is a perspective diagram showing a part of an opening system of a door lock device.

A preferred embodiment of this invention as shown in FIGS. 1 through 5 basically comprises a latch 1, a pawl 8, a motor M, an active lever 20, a latch lever 12, a pawl switch 25, and a latch switch 30.

Figure 2:
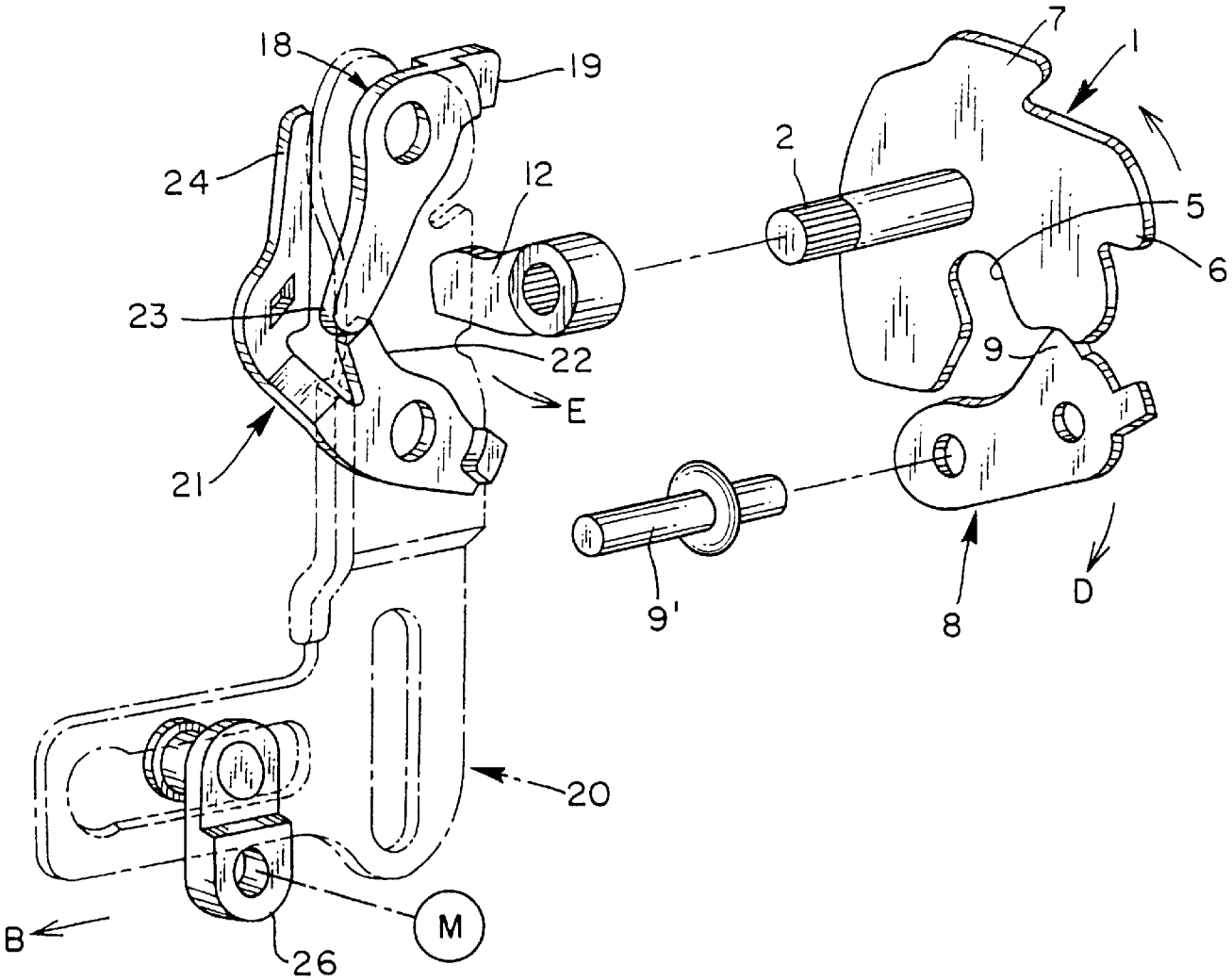
FIG. 2 is a perspective diagram showing a door closer portion of the door lock device.
Figure 6:
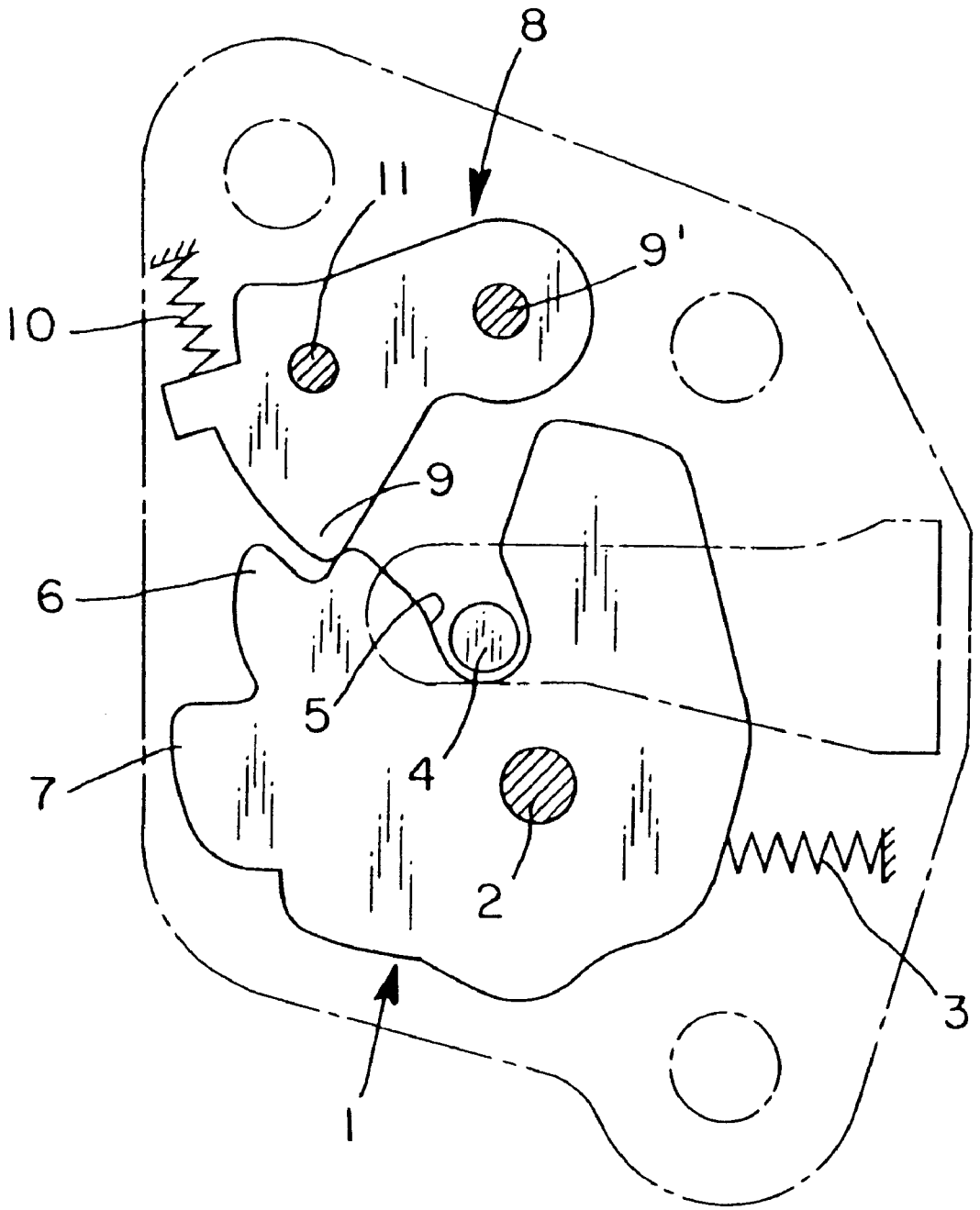
FIG. 6 is a plan diagram showing the relationship between a latch and a pawl.

First referring to FIGS. 1 and 2, the latch lever 12 is affixed to a pin 2 of the latch 1, a pin 9' of the pawl 8 is inserted into fitting holes 14 and 15 of a lift lever 11 and an open lever 13, and a pin 11' of the lift lever 11 is inserted into a hole 16 of the pawl S. In response to the movement of the lift lever 11 operated according to opening and closing operations of a door, the pin 11' rotates the pawl 8 clockwise (as viewed in FIG. 6) around the pin 9' and releases a protrusion 9 from contact thereof with projections 6 and 7. Namely, the open lever 13 is universally rotatable in the direction of A or B (in the door open direction). When the lever 13 is rotated in the direction of B in the example of FIG. 1, the lift lever 11 rotates in the direction of B. pivoting a segment 17 thereof in the direction of C and pushing down the pin 11'. Next, the pawl 8 is rotated in the direction of D, releasing the protrusion 9 from the projections 6 and 7 and creating an unlatched status (latch release) to enable the door to open.

A free end of the latch lever 12 is set against a segment 19 of an active latch 18 subjected to the urging force of a spring. The L-shape active latch 18 is rotatably connected to an active lever 20 and an active pawl subjected to the urging force of the spring, that is, a cancel lever 21 is connected by a pin to the active lever 20. The active pawl or the cancel lever 21 is approximately in the V shape, having a first arm 22 thereof in contact with a free end 23 of the active latch 18 as well as a long second a=m 24. A contact of the free end 23 with the first arm 22 blocks the counterclockwise rotation of the active latch 18 as viewed in FIG. 2.

Upon completion of the door closing operation, when the pawl switch 25 (refer to FIG. 1) detects the half-closed condition of the door, the electric motor M activates to rotate an output lever 26 thereof, moving the active lever 20 downward as viewed in FIG. 2. As a result, the segment 19 of the active latch 18 comes into contact with the free end of the latch lever 12, causing the latch lever 12 to rotate in the direction of E (as viewed in FIG. 2) and automatically bringing a pin 2, which is an integral part of the latch lever 12, and the latch 1 from a position of the half-latched status to a position of the full-latched status.

When the active latch 18 is in contact with the latch lever 12, the free end 23 of the active lever 19 is in contact with the active pawl or the first arm 22 of the cancel lever 21 to block the counterclockwise rotation (as viewed in FIG. 2) of the active latch 18, thus enabling the latch lever 12 to rotate in the direction of E. It is noted that the active latch 18 is rotatable clockwise.

In the event that clothes, hand baggage, and the like are grasped between the door and the body during the door closing operation resulting in changing the door position from the open condition to the half-closed condition, it is necessary to cancel the door closing operation by the door closer.

Figure 3:
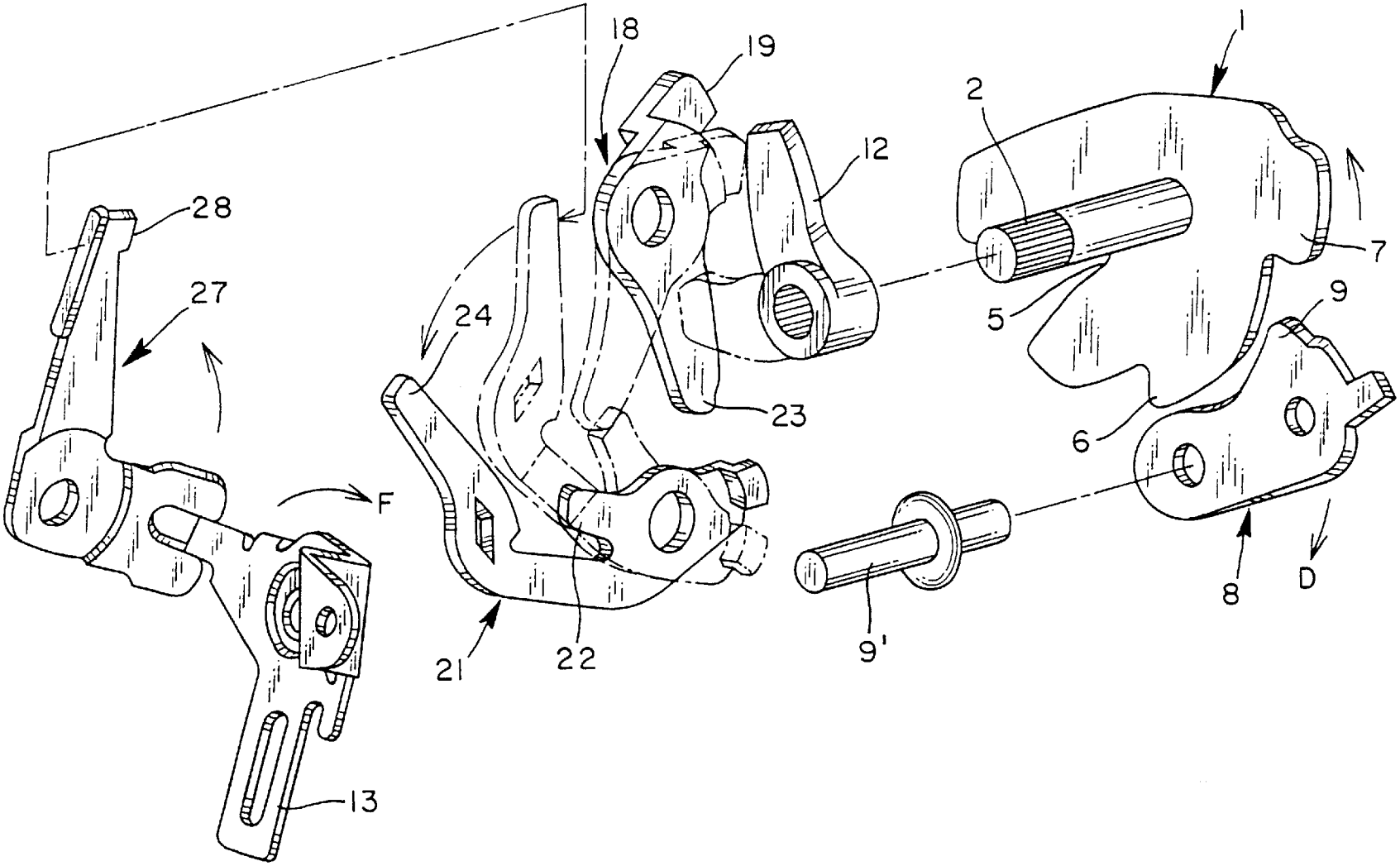
FIG. 3 is a perspective diagram illustrating a cancel operation.

When an object is held by the door, a door opening operation by operating the handle would cause an intermediate lever 27 to rotate counterclockwise as viewed in FIG. 3, making the open lever 13 rotate in the direction of F (equivalent to the direction of B in FIG. 1) and producing the same movement as the door opening movement explained in connection with FIG. 1. Such motion of the intermediate lever 27 causes a free end 28 thereof to come in contact with the second arm 24 of the active pawl 21, moving the active pawl 21 to a position shown in solidlines in FIG. 3. Consequently, engagement of the first arm 22 of the active pawl 21 with the free end 23 of the active latch 18 is released to put the active latch 18 in the universally pivotal condition.

When the pawl switch 25 detects the half-closed condition of the door in this state, as described in connection with FIG. 2, the electric motor M pushes down the active lever 20 and the active latch 18. However, since engagement of the first arm 22 of the active pawl 21 with the free end 23 of the active latch 18 is released, even if the segment 19 comes in contact with the latch lever 12, the active latch 18 rotates universally while there is no rotation of the latch lever 12. In this manner, there is no shift of the door position from the half-closed condition to the full-closed condition, and yet the door opening operation is performed.

Figure 4:
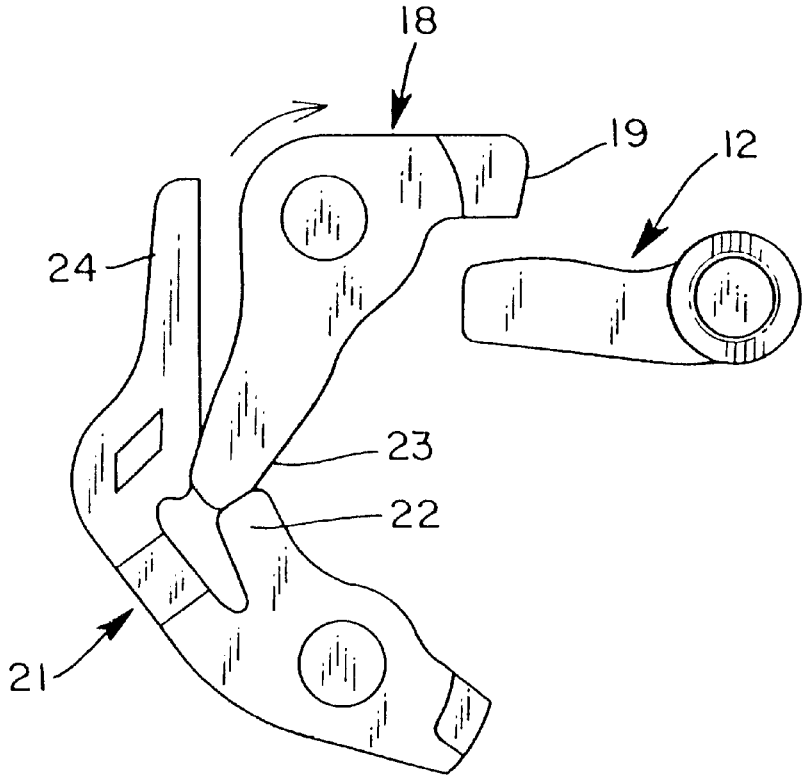
FIG. 4 is a diagram showing a normal relationship between an active latch and a latch lever.
Figure 5:
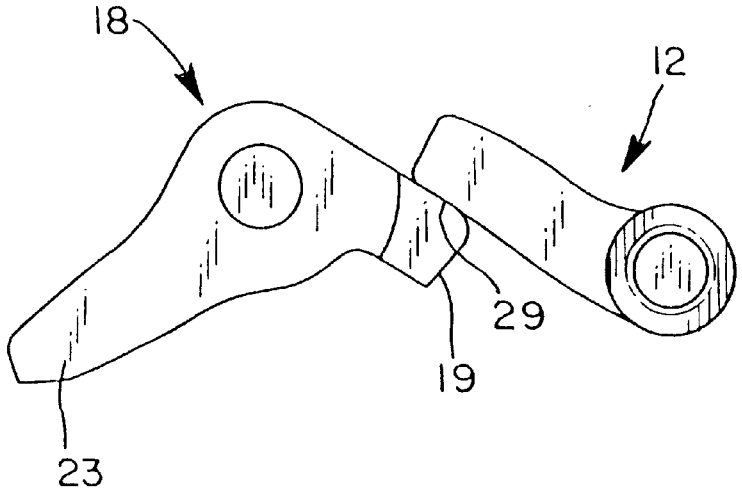
FIG. 5 is a diagram showing an abnormal relationship between an active latch and a latch lever.

In the above-mentioned operation, the free end of the latch lever 12 is positioned under the segment 19 of the active latch 18 as shown in FIG. 4, thereby enabling the active latch 18 to rotate counterclockwise upon rotation of the latch lever 12 or when the active pawl 21 is rotated counterclockwise. It is noted, however, that the door opening during the cancel operation may bring about a positional relationship as shown in FIG. 5 due to the freedom of rotation of the active latch 18, namely, an abnormal condition in which the free end of the latch lever 12 is positioned above the segment 19. In this instance, as a result of the door closing operation, the latch lever 12 is rotated counterclockwise by the latch 1 to put the segment 19 of the active latch 18 in contact with the free end of the latch lever 12, rotating the active latch 18 universally clockwise as viewed in FIG. 5 to obtain the normal condition shown in FIG. 4.

This avoidance of abnormality is accomplished by making the active latch 18 universally rotatable clockwise as viewed in FIGS. 4 and 5.

To avoid such abnormality, as shown in FIG. 5, the side which forms the free end of the latch lever 12 and which comes in contact with the segment 19 of the active latch 18 is so constructed as to form an incline 29. In the above-mentioned door closing operation, the latch lever 12 rotates counterclockwise to rotate the active latch universally, whereas the incline 29 reduces a side therebetween as well as a contact stroke at the contact part, thus enabling the latch lever 12 to return promptly to the normal position.

While the present invention has been described in regard to what is currently considered to be a preferred embodiment thereof, it is understood that the invention is not limited to the disclosed embodiment or construction. To the contrary, the invention is intended to cover various modifications and equivalent arrangements included within the spirit and scope of the appended claims.

What is claimed is:

1. A door closing device comprising:

a latch which is selectively positionable in a first position adapted to place a door in an operable state, a second position adapted to place the door in a half-closed state and a third position adapted to place the door in a full-closed state with respect to a member on a vehicle body;

a pawl engageable with the latch to maintain the latch in any one of said first, second and third positions;

an electric motor operable upon detection of the half-closed state of the door;

an active lever driven by the electric motor;

a rotatable active latch pivotally connected to the active lever;

a rotatable cancel lever engageable with the rotatable active latch to prevent the rotatable active latch from rotating in a first direction relative to the active lever; and a latch lever fixed to the latch and having a free end selectively engageable with the active latch through movement of the active lever, said rotatable active latch rotating the latch lever to position the latch in the third position when the rotatable cancel lever is engaged with the rotatable active latch, and the rotatable active latch being rotated in the first direction relative to the active lever by engagement with the latch lever when the rotatable cancel lever is disengaged from the rotatable active latch.

2. The door closing device according to claim 1, wherein the cancel lever engaged with the active latch allows rotation of the active latch in a second direction with respect to the active lever that is opposite to said first direction, the active latch being rotated in the second direction relative to the active lever by engagement with the latch lever.

3. The door closing device according to claim 1, including an inclined face formed at the free end of the latch lever for abutting the active latch.

4. The door closing device according to claim 1, wherein the cancel lever is coupled to an open lever and engaged and disengaged with the active latch by operation of the open lever.

* * * * *